US011123743B2

(12) United States Patent
Mueller et al.

(10) Patent No.: US 11,123,743 B2
(45) Date of Patent: Sep. 21, 2021

(54) METHOD FOR OPERATING A COMMINUTION CIRCUIT AND RESPECTIVE COMMINUTION CIRCUIT

(71) Applicant: ABB Schweiz AG, Baden (CH)

(72) Inventors: Georg Mueller, Glattpark (CH); Thomas Alfred Paul, Wädenswil (CH); Axel Kramer, Wettingen (CH); Detlef Pape, Nussbaumen (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/645,954

(22) PCT Filed: Sep. 17, 2018

(86) PCT No.: PCT/EP2018/075073
§ 371 (c)(1),
(2) Date: Mar. 10, 2020

(87) PCT Pub. No.: WO2019/053261
PCT Pub. Date: Mar. 21, 2019

(65) Prior Publication Data

US 2020/0276593 A1 Sep. 3, 2020

(30) Foreign Application Priority Data

Sep. 18, 2017 (EP) ..... 17191631

(51) Int. Cl.
*B02C 17/18* (2006.01)

(52) U.S. Cl.
CPC ..... *B02C 17/1805* (2013.01)

(58) Field of Classification Search
CPC ..... B02C 17/1805; B02C 11/08; B02C 25/00
(Continued)

(56) References Cited

U.S. PATENT DOCUMENTS 3,783,252 A * 1/1974 Putman ..... B02C 17/1805 700/122
3,860,804 A * 1/1975 Rutman ..... B02C 25/00 700/117

(Continued)

FOREIGN PATENT DOCUMENTS

CN 201427076 Y 3/2010
CN 204051862 U 12/2014

(Continued)

OTHER PUBLICATIONS

Extended European Search Report Application No. EP 17 19 1631 Completed: Nov. 23, 2017; dated Jan. 12, 2017 6 pages.

(Continued)

*Primary Examiner* — Shelley M Self
*Assistant Examiner* — Smith Oberto Bapthelus
(74) *Attorney, Agent, or Firm* — Whitmyer IP Group LLC

(57) ABSTRACT

A method for operating an ore comminution circuit is provided. The method includes obtaining at least one sensor signal related to an ore feed to the comminution circuit; determining a first ore grindability parameter of the ore feed from the at least one sensor signal, using a model; determining a second ore grindability parameter using parameters of the comminution circuit and/or of at least one comminution device in the comminution circuit; and updating the model with the second ore grindability parameter and the at least one sensor signal.

14 Claims, 4 Drawing Sheets

(58) Field of Classification Search
USPC ..... 241/34
See application file for complete search history.

(56) References Cited

U.S. PATENT DOCUMENTS

| | | | | |
|---|---|---|---|---|
| 4,624,367 | A * | 11/1986 | Shafer | B07C 5/10 209/577 |
| 6,259,222 | B1 * | 7/2001 | Kira | B02C 25/00 241/35 |
| 2013/0153694 | A1 * | 6/2013 | Held | B02C 25/00 241/15 |

FOREIGN PATENT DOCUMENTS

| | | | |
|---|---|---|---|
| CN | 104703716 | A | 6/2015 |
| CN | 204933653 | U | 1/2016 |
| CN | 105478220 | A | 4/2016 |
| CN | 205269784 | U | 6/2016 |
| DE | 102006019417 | A1 | 11/2007 |

OTHER PUBLICATIONS

Guyot O et al: "VisioRock, an integrated vision technology for advanced control of comminution circuits", Minerals Engineering. Pergamon Press. Oxford, GB vol. 17, No. 11-12, Nov. 1, 2004 10 pages.

Written Opinion of the International Searching Authority and International Search Report Application No. PCT/EP2018/075073 Completed: Dec. 7, 2018; dated Dec. 14, 2018 10 pages.

Chinese Office Action and Search Report with Translation; Application No. 2018800603753; dated Feb. 3, 2021; 16 Pages.

* cited by examiner

METHOD FOR OPERATING A COMMINUTION CIRCUIT AND RESPECTIVE COMMINUTION CIRCUIT

Aspects of the present disclosure relate to ore milling, in particular to a method for operating and controlling a comminution circuit, and a respective comminution circuit, as well as for controlling processes before and after such a circuit. More particularly, the methods and systems described herein include methods and systems of determining an ore hardness.

TECHNICAL BACKGROUND

Today, ore hardness, which is a factor heavily influencing grindability, is typically assessed only in lab tests for mine planning and geological studies with low periodicity, e.g., on a monthly basis. Ore hardness is often defined as the work index (given typically in kWh/ton) derived from measuring a feed tonnage and the mill power draw, as well as product and feed particle size, e.g., in a small lab-based model mill. In some cases, ore hardness was deduced from the drillability during blast hole drilling. This information was passed on to the concentration process by ore tracking via stockpile management. It was also shown that the ore grindability can be empirically determined by ore analysis based on machine vision.

Several strategies for using an online ore hardness measurement for the process control of the concentrator plant are known, for example from O. Guyot et al.: "VisioRock, an integrated vision technology for advanced control of comminution circuits", Minerals Engineering 17 (2004) 1227-1235. In addition, there is a great number of sensor technologies used in commercial products for ore analysis and grade uplift, which include LIBS, PGNA, XRF, color measurement, NIR spectroscopy, electromagnetic spectroscopy, and XRT. Product and feed particle size are today assessed on-line by commercial particle size monitors.

However, such conventional methods leave room for improvement. In view of the above and for other reasons, there is a need for the present invention.

SUMMARY OF THE INVENTION

In view of the above, a method for operating an ore comminution circuit and a control system for a comminution circuit are provided.

According to a first aspect, a method for operating an ore comminution circuit, comprising at least one comminution device, is provided. The method includes obtaining at least one sensor signal, related to an ore feed to the comminution circuit; determining a first ore grindability parameter of the ore feed from the at least one sensor signal by using a model; determining a second ore grindability parameter using parameters of the comminution circuit and/or of at least one comminution device in the comminution circuit; and updating the model with the second ore grindability parameter and the at least one sensor signal.

According to second aspect, a control system for a comminution circuit is provided. The system includes a control unit and optionally at least one sensor and is adapted for carrying out the method of the first aspect.

Further advantages, features, aspects and details that can be combined with embodiments described herein are evident from the dependent claims, the description and the drawings.

BRIEF DESCRIPTION OF THE FIGURES

More details will be described in the following with reference to the figures, wherein.

ASPECTS OF THE INVENTION

Figure 1:
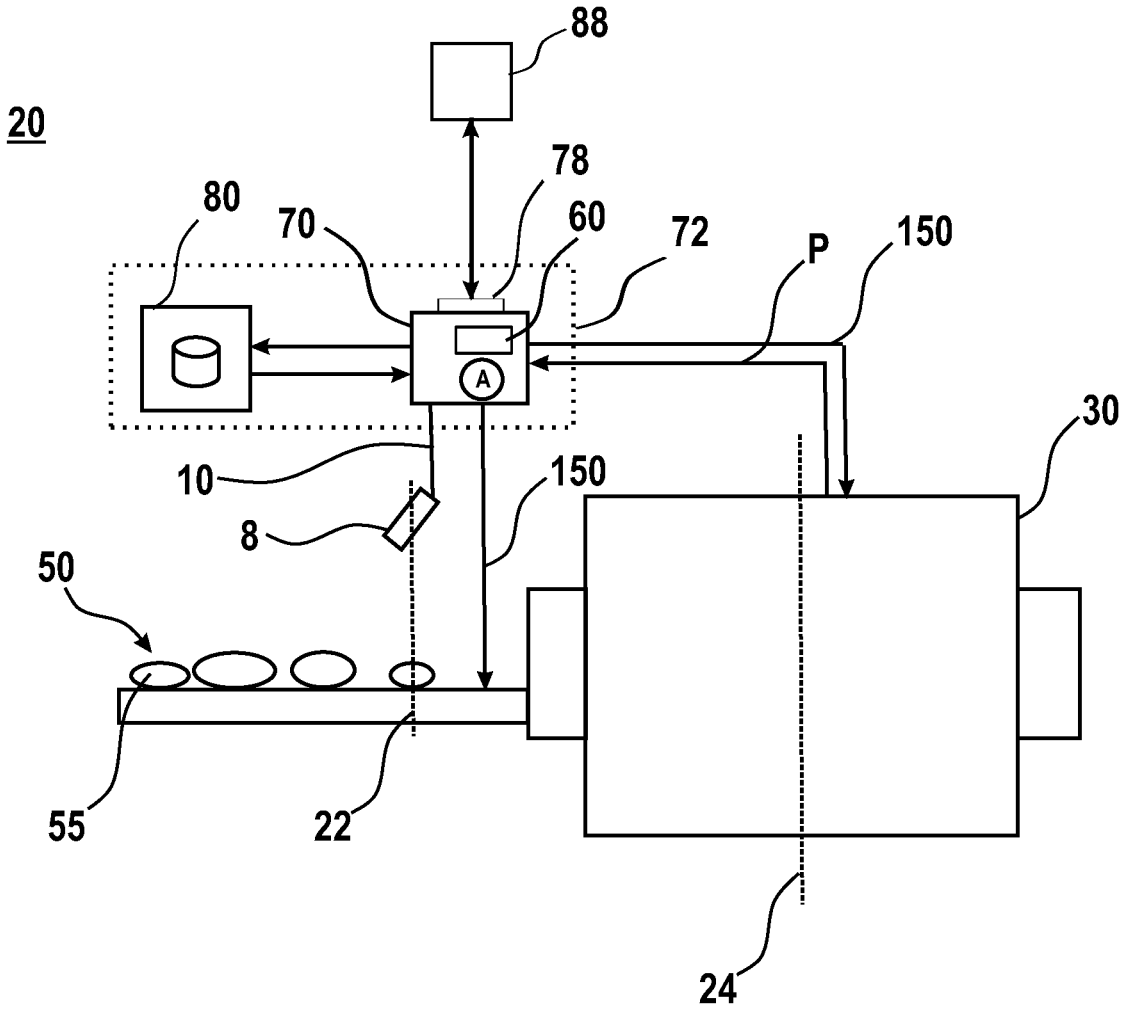
FIG. 1 is a schematic view of a comminution circuit with a control system according to embodiments.

In the following, some general aspects of the invention are described. Each aspect may be combined with each other aspect or with any of the embodiment described herein, as long as this is technically feasible, or unless otherwise stated.

According to an aspect, a method for operating an ore comminution circuit, comprising at least one comminution device, comprises obtaining at least one sensor signal which is related to an ore feed to the comminution circuit, in particular, at least two sensor signals. From the at least one sensor signal, a first ore grindability parameter of the ore feed is determined by using a model. A second ore grindability parameter is determined using parameters of the comminution circuit and/or of the at least one comminution device in the comminution circuit. The model is updated using the second ore grindability parameter and the at least one sensor signal.

According to an aspect, the first ore grindability parameter is used as a parameter for the control of the comminution circuit.

According to an aspect, at least two sensors are employed in the comminution device, delivering at least two sensor signals.

According to an aspect, at least one retention time of the ore comminution circuit is considered, wherein the time is determined to be between at least one first location of at least one sensor acquiring the at least one sensor signal, and at least one second location of the at least one comminution device.

According to an aspect, the comminution device is at least one of an ore mill, a SAG mill, a AG mill, a ball mill, a rod mill, a tumbling mill, a gearless mill, a geared mill, a crusher, and high-pressure grinding rolls.

According to an aspect, at least a part of the above described method is quasi-continuously or repeatedly carried out.

According to an aspect, the first ore grindability parameter and/or at least one of the at least one sensor signal is further used for controlling at least one process or device provided outside the comminution circuit. This process or device is preferably at least one of: a grade upflift, an ore blending, and a flotation.

According to an aspect, the steps of determining a first ore grindability parameter, and/or of updating the model are carried out via at least one algorithm. The at least one algorithm preferably uses at least one of: linear regression, multivariate analysis, principal component analysis, logistic regression, machine learning, deep learning, artificial neural network, and support vector machine.

According to an aspect, a control unit is implemented on at least one computer spatially close to the comminution circuit. The control unit may also be implemented in parts on at least one computer spatially close to the comminution circuit, and in parts on at least one computer remote from the comminution circuit.

According to an aspect, the first ore grindability parameter is determined by the control unit by further taking into account at least one parameter, preferably a set of calibration factors, from a database, which may be provided in the control unit. Thereby, the database may at least partially be updated during the updating of the model.

According to an aspect, the control unit uses as parameters of the comminution circuit and of the at least one comminution device for determining the second ore grindability parameter at least one of: power consumption of the at least one comminution device, a charge or filling level of the at least one comminution device, a speed of the at least one comminution device, a ball or pebble charge of the at least one comminution device, a feed particle size of the at least one comminution device, and a product particle size of the at least one comminution device.

According to an aspect, the control of the comminution circuit includes at least one of: an adaptation of a ball or a pebble charge, an adaption of a feed tonnage, an adaption of a water feed, a modification of a blending of the ore, an adaptation of belt speed, and an adaption of a mill speed.

According to an aspect, the at least one sensor signal results from at least one of the following methods: ore tracking, stockpile management, ore tagging, a particle size measurement, an optical analysis and/or reflectometry in the visible range, optical analysis and/or reflectometry in the UV, optical analysis and/or reflectometry in the NIR and/or MIR, acoustical method, machine vision, imaging, hyperspectral imaging, multispectral imaging, LIBS, PGNA, XRF, XRL, LIF, a color measurement, a photothermal measurement, visible/UV/NIR/MIR spectroscopy, THz spectroscopy, electromagnetic spectroscopy in at least one frequency range from 1 kHz to 10 GHz.

According to an aspect, the at least one sensor signal results at least partially from an acoustical method. In the acoustical method, the sound of a mechanical impact of at least parts of the ore feed are recorded. This may include impinging a part of the ore feed on a surface, e.g. when falling for a defined distance, or an actively produced mechanical impact of objects on a part of the ore feed. The resulting sound may be recorded, in particular, by a microphone or generally a vibration sensor, and analyzed, in particular, by Fourier analysis.

According to an aspect, a first and/or second ore grindability parameter is a work or power index or a set of work or power indices.

According to an aspect, a control system for a comminution circuit is provided and includes a control unit and optionally at least one sensor. The system is adapted for carrying out methods according to any of the aspects or embodiments as described herein, or of combinations thereof.

According to an aspect, the control system comprises a network interface for connecting the control system to a data network, wherein the control system is operatively connected to the network interface for at least one of: carrying out a command received from the data network, sending status information of the control system to the data network, and sending measurement data of the control system to the data network.

DETAILED DESCRIPTION OF THE FIGURES AND EMBODIMENTS

Although specific features of various embodiments of the invention may be shown in some drawings and not in others, this is for convenience only. In accordance with the principles of the invention, any feature of a drawing may be referenced and/or claimed in combination with any feature of any other drawing.

As used herein, a "sensor signal" according to the present disclosure is any kind of information that can be used to characterize, categorize, or attribute parameters to the ore feed. In particular, as used herein, the terms "ore tracking" and "stockpile management" are intended to mean procedures or mechanisms so that the source of an ore feed currently delivered to a comminution circuit can be attributed to its origin. This can, e.g., be achieved by principally tracking the ore material from the point in time were it is removed from the ground, during a temporary or permanent storage period, up to the point in time when the material is transported and has reached the comminution circuit. When a mechanism is in place that ensures that the ore material can be reliably attributed to its location of origin (typically: within the same mine), information obtained earlier about the properties of this material may be attributed to a current ore feed. By doing so, parameters may be attributed to a current ore feed. This type of information may then be used in embodiments as a sensor signal, according to embodiments described herein. The term "ore tagging" is intended to mean a procedure or mechanism to mark ore using tags, in particular, RFID tags, enabling attributing information obtained earlier about the ore of the current ore feed by identifying the tags. Accordingly, identification of the tags, more precisely of the information related to the tags, is regarded as a sensor signal according to this disclosure.

As used herein, the term "model" is to be understood broadly and describes an instance which enables to derive an output value (or set of values) from at least one input value. The model is typically realized as a form of software for a computer, which can include, or be used together with, a database comprising data which is used by the software. In particular, a model serves the purpose to obtain an output being at least one ore grindability parameter of an ore feed, while using sensor signals and/or parameters from a comminution circuit as an input. Generally, the model may comprise heuristic functions, statistical functions, and/or at least one mathematical algorithm. The model can be modified, in particular it may be updated in order to improve the quality of the output results. The updating is used in embodiments to adapt and improve the model using a comparison of the model output with measured parameters, according to a feedback principle.

As used herein, the term "computer" is understood as any sort of device, preferably a microelectronic device, capable of executing logical and/or arithmetic operations.

FIG. 1 shows a comminution circuit 20 according to embodiments, with a control system according to embodiments, which are both adapted to be operated by a method 100 according to embodiments. The comminution circuit 20 includes at least one comminution device 30.

The comminution device 30 may typically be at least one device from the list consisting of: an ore mill, a SAG mill, a AG mill, a ball mill, a rod mill, a tumbling mill, a gearless mill, a geared mill, a crusher, and high-pressure grinding rolls. The comminution circuit 20 is typically continuously fed with pieces of ore 55 by an ore feed 50. The ore feed 50 is typically monitored (supervised) with at least one sensor 8. An at least one sensor signal 10 of the at least one sensor 8 is related to the ore feed 50 leading to the comminution device 30. In case of more than one comminution device in the comminution circuit, the different devices can be arranged in series on in parallel to each other.

The sensor signal 10 is used as an input for a control unit 70. The control unit 70 determines, typically continuously or frequently, a first ore grindability parameter GP1 from the at least one sensor signal 10. The conjunction between the value of the sensor signal 10 and the first ore grindability parameter GP1, as employed by the control unit 70, may be defined in a number of ways. Generally, the conjunction is defined by a model 60. In embodiments, the model may for example be, in a simple case, a look-up table, wherein a first ore grindability parameter GP1 is attributed to each of a number of values of the sensor signal 10 in the table. The model 60 may also include a numerical approximation, wherein the value of the first ore grindability parameter GP1 is attributed to a value of the sensor signal by, e.g., inserting the sensor signal 10 as an input into, e.g., a polynomial. In a further variant, the model 60 may be realized as the function of a neuronal network, which delivers the first ore grindability parameter GP1 as an output value for an input sensor signal 10.

Typically, the first ore grindability parameter GP1 and/or a second ore grindability parameter GP2 as used herein are a work index or a power index, or a set of work or power indices, which are principally known in the art as parameters in the field of ore processing. Generally, the model 60 may comprise an algorithm, and/or heuristic and/or statistical functions.

The at least one sensor signal 10 may be obtained by a variety of methods. Generally, each method or process may be employed for receiving the sensor signal 10, which is suitable to deliver a value or set of values which are regarded to provide a sufficiently reliable correlation with a first ore grindability parameter GP1 of the ore feed 50. The skilled person will readily understand that generally, there exist a plethora of parameters and methods for obtaining those, from which an ore grindability parameter GP1, may be deduced. According to embodiments, the following methods or principles can be employed to obtain the first sensor signal 10: an ore tracking, a stockpile management, an ore tagging (e.g., with RFID chips in the ore feed), a particle size measurement, an optical analysis and/or reflectometry in the visible range, an optical analysis and/or reflectometry in the UV, an optical analysis and/or reflectometry in the NIR and/or MIR, an acoustical method, a machine vision system, generally imaging, hyperspectral imaging, and/or multispectral imaging, LIBS, PGNA, XRF, XRT, LIF, a color measurement, a photothermal measurement, a visible/UV/NIR/MIR spectroscopy, THz spectroscopy, or electromagnetic spectroscopy in at least one frequency range from 1 kHz to 10 GHz. Also two or more of the former may be employed in combination (sensor fusion) in order to obtain the first sensor signal 10, which can hence also be a sensor fusion signal. Acoustical method means that the sound of a mechanical impact of at least parts of the ore feed are recorded. This may include impinging a part of the ore feed on a surface, e.g. when falling for a defined distance, or an actively produced mechanical impact of objects on a part of the ore feed. The resulting sound may be recorded, in particular, by a microphone or generally a vibration sensor, and analyzed, in particular, by Fourier analysis.

When the control system or the method is started for the first time, the model is typically in an initial status, as defined by the manufacturer or programmer of the software of the control unit 70. This initial status can necessarily typically only be a more or less rough estimation, leading to a so determined first ore grindability parameter GP1 which may deviate from the actual value of the ore feed.

In embodiments, it is a general aim to provide a control system 72 and/or method for operating the comminution circuit, wherein the model 60 is gradually adapted over time, in order to deliver more accurate results for the ore grindability parameter GP1. Hence, the quality of prediction of the model 60 is improved during operation. To this end, a second ore grindability parameter GP2 is determined in order to use it as a correction value for the model 60. Typically, the second ore grindability parameter GP2 may include, or be calculated based upon, at least one parameter of the comminution circuit 20, and/or a parameter of at least one comminution device 30 in the comminution circuit 20. The parameter may typically include a power consumption or power draw of the comminution device 30. It is understood that the parameter may be realized in a number of ways, e.g. by measuring an electrical current or power draw of the comminution device 30.

By using the second ore grindability parameter GP2, a step of updating 130 the model 60 with the second ore grindability parameter GP2 is employed. Hence, by using the second ore grindability parameter and a current sensor signal 10, the model 60 is updated so that the accuracy of the determined first ore grindability parameter GP1 is improved.

In embodiments, the first ore grindability parameter GP1 is used for controlling 150 the comminution circuit 20. For example, the control unit 70 may adapt parameters of the ore comminution device 30 by taking into account a change in the grindability of the ore 55 in the ore feed 50. When the hardness of the ore changes, i.e. increases or decreases, e.g., due to a change of the type of the feed material, the detected change in the first ore grindability parameter may be used to change at least one parameter of the comminution circuit 20 and/or a comminution device 30. The parameter to be changed may for example be chosen from the (non-limiting) list including: power consumption of the at least one comminution device 30, a charge or filling level of the at last one comminution device 30, a speed of the at least one comminution device 30, a ball charge or pebble charge of the at least one comminution device 30, a feed particle size of the at least one comminution device 30, and a (produced) product particle size coming out of the at least one comminution device 30.

In the control method 100 for the comminution circuit according to embodiments, there may further be used at least one retention time (delay time) caused by the transport of the ore through the comminution circuit 20. More precisely, the least one retention time is defined as the time which a certain (small) ore portion needs to pass through the ore comminution circuit 20 between the at least one first location 22 (see FIG. 1) of the at least one sensor 8, which acquires the at least one sensor signal 10, and a second location 24 in the at least one comminution device 30. Considering the retention time includes the time delay between the acquisition of the first sensor signal 10, and the acquisition of the parameter of the comminution device 30 is accounted for in the control unit 70.

Typically, the above described steps of obtaining sensor signals and parameters, as well as correcting the model 60 are quasi-continuously carried out, or are repeatedly carried out in defined time intervals. In embodiments, the first ore grindability parameter GP1 and/or the at least one sensor signal 10 may further be used for controlling a process or device outside of the comminution circuit 20. As non-limiting examples, one or more of a grade upflift, an ore blending, and a flotation may be controlled by the control unit 70 using the first ore grindability parameter GP1.

The above described steps of determining the first ore grindability parameter GP1, and/or of updating the model 60, are typically carried out via an algorithm A in the control unit 70. The algorithm A uses at least the first sensor signal 10 and a parameter of the comminution device 30 as an input. Thereby, the process of updating the model 60 is carried out generally employing a concept of a feedback loop or machine learning. The skilled person will readily understand that the algorithm A may be realized in a great number of ways, wherein the definition of "algorithm" may include concepts which reach beyond the classical understanding of the term. As examples, possible realizations of the algorithm or at least parts of the algorithm may include at least one of linear regression, multivariate analysis, principal component analysis, logistic regression, machine learning, deep learning, artificial neural network, and support vector machine.

Figure 4:
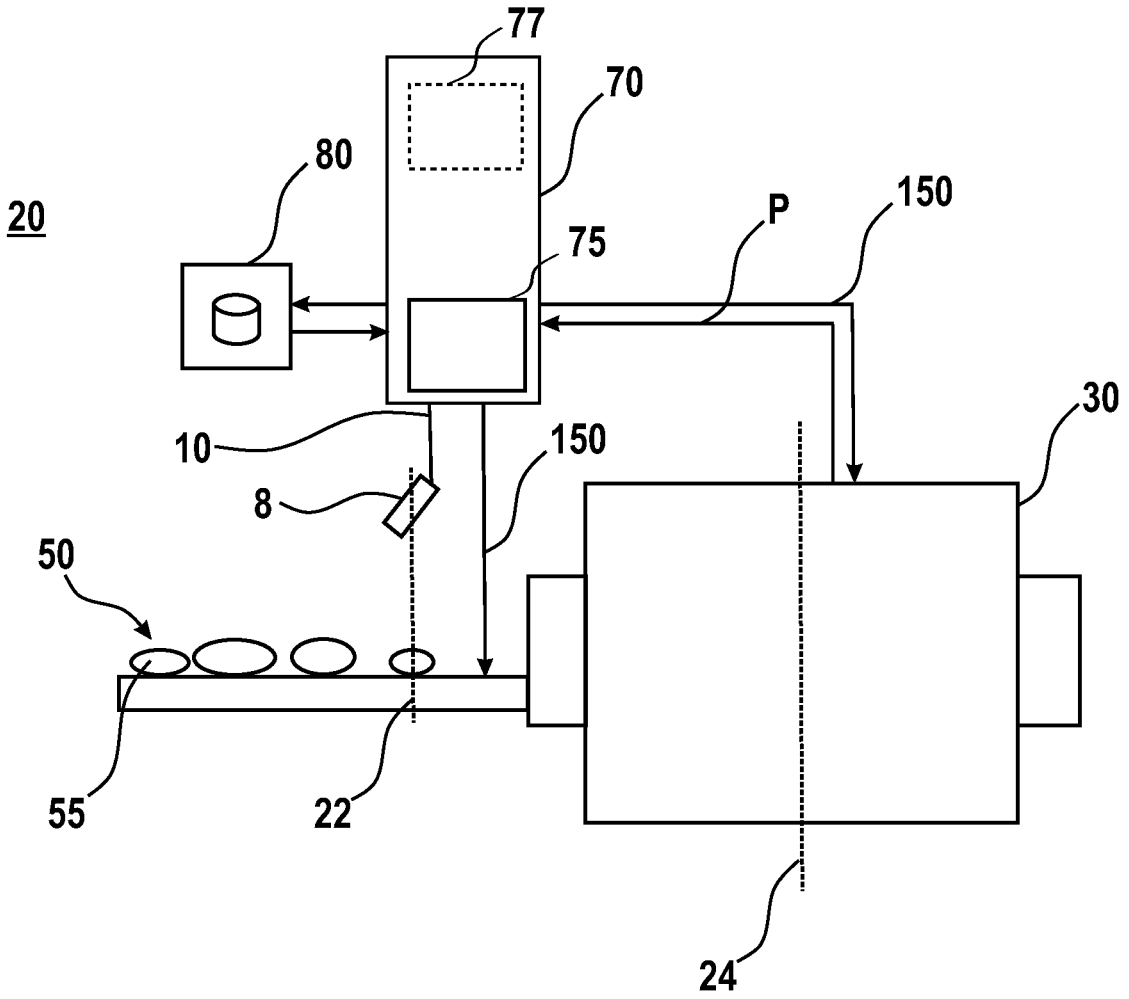
FIG. 4 is a schematic view of the comminution circuit of FIG. 1, showing an implementation of the control system.

Generally, the control unit 70 is implemented on at least one computer 75 (see FIG. 4). The computer 75 may typically be located spatially close, or adjacent to, the comminution circuit 20. Further, the control unit 70 may also be implemented at least partially on a remote computer 77. For example, the remote computer may be realized by a number of distributed computers in a plurality of remote locations, also known as cloud computing.

In embodiments, the first ore grindability parameter GP1 may be determined by the control unit 70 by further taking into account at least one further parameter, apart from the model 60. This parameter may also be a set of parameters, for example a set of calibration factors stored in a database 80 provided in, adjacent to, or remote from the control unit 70. The parameter, or set of calibration factors, stored in the database 80 may, at least partially, be updated during the step of updating the model 60.

The control unit 70 is configured to control the comminution circuit 20, in particular a comminution device 30 thereof, depending on the first ore grindability parameter GP1. It goes without saying that controlling the comminution circuit 20 may include controlling a large number of possible control parameters. In a non-exhaustive list, some of the parameters which may be influenced by the control unit 70 are: the ball charge or pebble charge, a feed tonnage, a water feed, a blending of the ore, a belt speed of the ore feed, and the mill speed. These parameters may be controlled individually or in various combinations. The reaction of the control unit 70 in response to a change of the first ore grindability parameter GP1 is typically determined by the model 60, optionally in conjunction with parameters from the database 80.

According to embodiments, a control system 72 for a comminution circuit includes a control unit 70 and optionally at least one sensor 8. The control system is adapted for carrying out a method of operating or controlling a comminution circuit 20 including at least one comminution device 30.

According to further embodiments, the control unit 70 comprises a network interface 78 for connecting the control system to a data network 88. The control system is operatively connected to the network interface and may be adapted for, e.g.: carrying out a command received from the data network, sending status information of the control unit 70 to the data network, and sending measurement data obtained by the control unit 70 to the data network.

Figure 2:
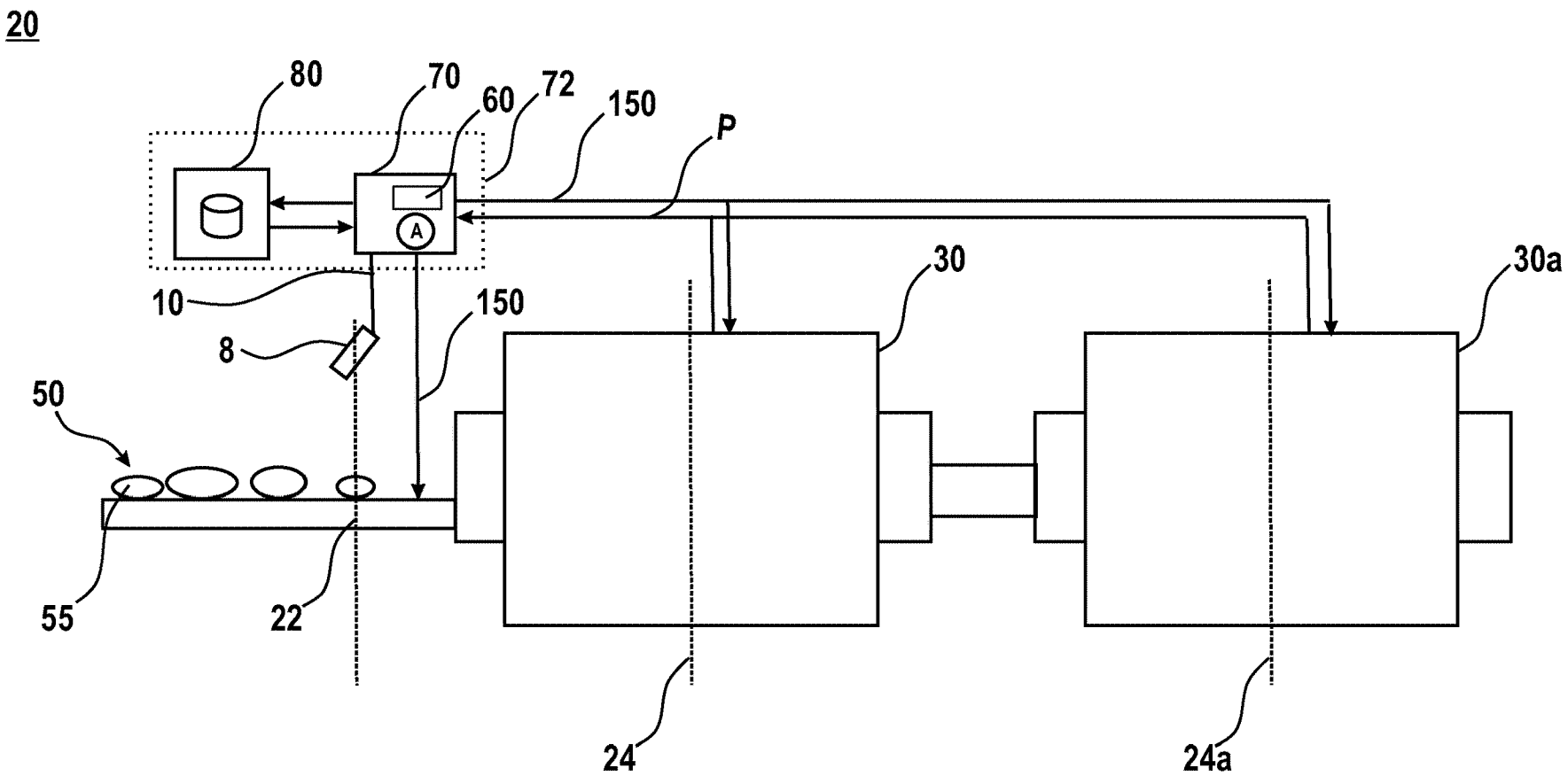
FIG. 2 is a schematic view of a comminution circuit with a control system according to further embodiments.

FIG. 2 shows a comminution circuit 20 based on the embodiment shown in FIG. 1, comprising a further comminution device 30*a*. There are different retention times between first location 22 at the sensor 8 and the second location 24 at the comminution device 30 as well as between first location 22 at the sensor 8 and the second location 24*a* at the further comminution device 30*a*; the two retention times between first location 22 and the second location 24 and the further second location 24*a* are taken into account by the control unit 70.

Figure 3:
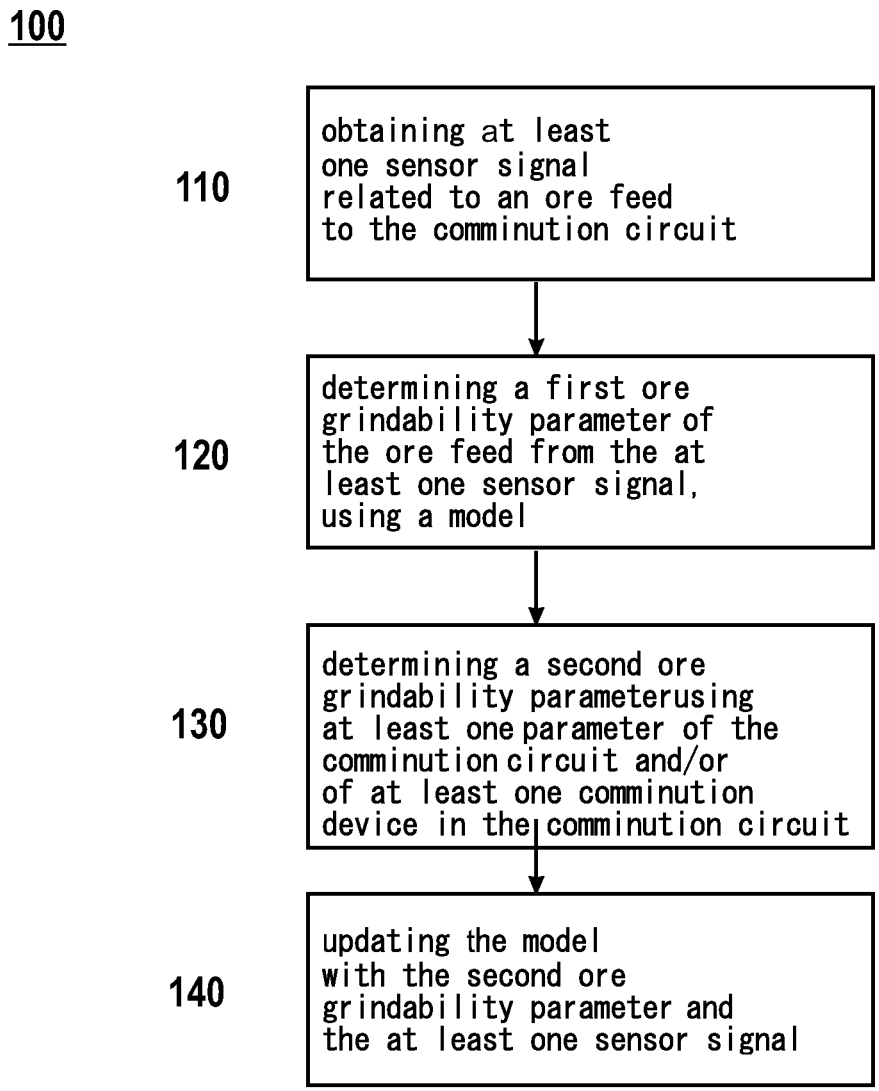
FIG. 3 is a schematic depiction of a method according to embodiments.

In FIG. 3, a schematic diagram of a method 100 according to embodiments is depicted. The method 100 for operating an ore comminution circuit 20 which comprises at least one comminution device 30, 30*a*, comprises: obtaining 110 at least one sensor signal 10 related to an ore feed 50 to the comminution circuit 20; determining 120 a first ore grindability parameter GP1 of the ore feed 50 from the at least one sensor signal 10, using a model 60; determining 130 a second ore grindability parameter GP2 using at least one parameter P of the comminution circuit 20 and/or of the at least one comminution device 30, 30*a* in the comminution circuit 20; and updating 140 the model 60 with the second ore grindability parameter GP2 and the at least one sensor signal 10. The optional step of controlling 150 is not shown in FIG. 3.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

LIST OF REFERENCE NUMERALS

Sensor 8
Sensor signal 10
First ore grindability parameter GP1
Parameter of the comminution circuit P
Second ore grindability parameter GP2
Comminution circuit 20
First location 22
Second location 24, 24*a*
Comminution device 30, 30*a*
Ore feed 50
Ore 55
Model 60
Control unit 70
Control system 72
Computer 75, 77
Database 80
Method 100
Obtaining 110
Determining a first ore grindability parameter 120
Determining a second ore grindability parameter 130
Updating 140
Controlling 150
Algorithm A

The invention claimed is:

1. A method for operating an ore comminution circuit comprising at least one comminution device, the method including:

obtaining at least one sensor signal related to an ore feed to the comminution circuit;

determining a first ore grindability parameter of the ore feed from the at least one sensor signal, using a model;

determining a second ore grindability parameter using at least one parameter of the comminution circuit and/or of the at least one comminution device in the comminution circuit;

updating the model with the second ore grindability parameter and the at least one sensor signal.

2. The method of claim 1, further comprising:

employing the first ore grindability parameter by a control unit for controlling the comminution circuit.

3. The method of claim 2, wherein the control unit is implemented at least in parts on at least one remote computer.

4. The method of claim 2, wherein the control unit uses at least one parameter of the comminution circuit and/or of the at least one comminution device for determining the second ore grindability parameter, the at least one parameter being from a list including:

power consumption of the at least one comminution device, a charge or filling level of the at least one comminution device, a speed of the at least one comminution device, a ball or pebble charge of the at least one comminution device, a feed particle size of the at least one comminution device, and a product particle size of the at least one comminution device.

5. The method of claim 2, wherein controlling the comminution circuit includes at least one of: an adaptation of a ball or a pebble charge, an adaption of a feed tonnage, an adaption of a water feed, a modification of a blending of the ore, an adaptation of belt speed, and an adaption of a mill speed.

6. The method of claim 1, wherein the method is executed using at least one retention time of the ore comminution circuit between at least one first location of at least one sensor acquiring the at least one sensor signal, and at least one second location of the at least one comminution device.

7. The method of claim 1, wherein the at least one comminution device is at least one of: an ore mill, a SAG mill, a AG mill, a ball mill, a rod mill, a tumbling mill, a gearless mill, a geared mill, a crusher, and a grinding roll.

8. The method of claim 1, wherein at least a part of the method is quasi-continuously or repeatedly carried out.

9. The method of claim 1, wherein determining a first ore grindability parameter, and/or updating the model, are carried out via at least one algorithm.

10. The method of claim 9, wherein the at least one algorithm uses at least one of: linear regression, multivariate analysis, principal component analysis, logistic regression, machine learning, deep learning, artificial neural network, and support vector machine.

11. The method of claim 1, wherein first and/or second ore grindability parameter is a work or power index or a set of work or power indices.

12. The method of claim 1, wherein the at least one sensor signal results from at least one of the following methods: ore tracking, stockpile management, a particle size measurement, an optical analysis and/or reflectometry in the visible range, optical analysis and/or reflectometry in the UV, optical analysis and/or reflectometry in the NIR and/or MIR, acoustical method, machine vision, imaging, hyperspectral imaging, multispectral imaging, LIBS, PGNA, XRF, XRL, LIF, a color measurement, a photothermal measurement, visible/UV/NIR/MIR spectroscopy, THz spectroscopy, electromagnetic spectroscopy in at least one frequency range from 1 kHz to 10 GHz;

wherein the acoustical method includes recording and analyzing a sound of a mechanical impact of at least parts of the ore feed, which includes impinging a part of the ore feed on a surface or an actively produced mechanical impact of objects on a part of the ore feed.

13. A control system for a comminution circuit, comprising a control unit and at least one sensor, the control system being adapted to carry out the method of claim 1.

14. The control system of claim 13, further comprising a network interface for connecting the control system to a data network, wherein the control system is operatively connected to the network interface for at least one of: carrying out a command received from the data network, sending status information of the control system to the data network, and sending measurement data of the control system to the data network.

* * * * *